United States Patent [19]

Napolitano

[11] Patent Number: 4,521,156

[45] Date of Patent: Jun. 4, 1985

[54] SELF-PRIMING PUMP SYSTEM HAVING DIAPHRAGM-TYPE FLOW SENSOR

[75] Inventor: Pellegrino E. Napolitano, Middletown, N.J.

[73] Assignee: Hudson Engineering Company, Bayonne, N.J.

[21] Appl. No.: 450,366

[22] Filed: Dec. 16, 1982

[51] Int. Cl.[3] ..... F01B 25/00

[52] U.S. Cl. ..... 415/11

[58] Field of Search ..... 415/11, 26, 27, 28; 417/199 A, 278, 300

[56] References Cited

U.S. PATENT DOCUMENTS

| | | | |
|---|---|---|---|
| 2,470,565 | 5/1949 | Loss | 415/11 |
| 3,370,604 | 2/1968 | Napolitano | 415/11 |
| 3,381,618 | 5/1968 | Napolitano | 415/11 |
| 4,255,079 | 3/1981 | Piegza | 415/11 |

*Primary Examiner*—Henry C. Yuen
*Assistant Examiner*—John Kwon
*Attorney, Agent, or Firm*—Fleit, Jacobson, Cohn & Price

[57] ABSTRACT

A self-priming system for liquid pumps wherein a priming valve is provided to convey a quantity of priming liquid to the pump upon loss of pump suction. A pilot valve is provided to regulate the pressure against a piston which serves to maintain the priming valve closed. The pilot valve controls the liquid pressure exerted against the piston and thereby regulate the pressure level at which the priming valve will open. The pilot valve can be electrically actuated by means of a flow sensor including a diaphragm operated switch responsive to liquid flow.

11 Claims, 4 Drawing Figures

SELF-PRIMING PUMP SYSTEM HAVING DIAPHRAGM-TYPE FLOW SENSOR

BACKGROUND OF THE INVENTION

This invention relates to self-priming systems for liquid pumps and more particularly to a self-priming pump system wherein a fast-acting, tee-type priming valve is provided to permit automatic priming of the pump.

Self-priming liquid pumping systems are disclosed in U.S. Pat. Nos. 3,370,604 and 3,381,618, each of which is commonly owned by the assignee of the present invention. As there shown, a pump is positioned so that its suction inlet line is submerged in a suction chamber, and a check valve is provided in the discharge to prevent reverse flow of liquid when suction is lost. A priming valve is positioned between the pump discharge and the check valve to permit the column of liquid therebetween to flow back to the suction chamber and prime the pump.

Previous priming valves included spring-biased valves responsive to liquid dynamic pressure to control the flow of priming liquid to the pump suction inlet. Actuation of the priming valve was by means of a pressure sensing tube which extended into the flow stream, or, alternatively, a venturi was provided to sense the reduced static pressure of the flowing fluid as it passed through the throat of the venturi, and each arrangement caused the priming valve to open when no flow was taking place.

Although the prior art priming valves are entirely suitable for their intended purpose, it is desirable to provide a more rapid acting priming valve construction.

SUMMARY OF THE INVENTION

It is an object of the present invention to provide a rapid acting priming valve which does not incorporate a spring to bias the valve to a predetermined position.

It is another object of the present invention to provide a priming valve wherein the operation of the valve is dependent solely upon fluid pressures existing in the pumping system.

It is still another object of the present invention to provide a priming valve wherein the control of the actuation range of the valve is accomplished externally of the valve structure.

Briefly stated, in accordance with one aspect of the present invention, a self-priming liquid pumping system is provided which incorporates an improved valve structure for providing the priming liquid for a liquid pump. The system includes a check valve positioned downstream of the pump outlet, the fluid upstream of the check valve comprising the priming fluid. An improved priming valve in accordance with the present invention includes a valve member connected to a piston which serves to position the valve member with respect to a valve seat. The rear face of the piston is exposed to the discharge line static pressure and a fluid bleed line extends from the piston chamber to conduct fluid back to the suction tank. A pilot valve is positioned in the bleed line and is controlled by a flow sensor to cause it to open under a given flow condition, such as no flow. The fluid in the piston chamber is dumped to the suction tank and the priming valve then opens due to the pressure differential created across the piston, hence, repriming takes place.

DESCRIPTION OF THE PREFERRED EMBODIMENTS

Figure 1:
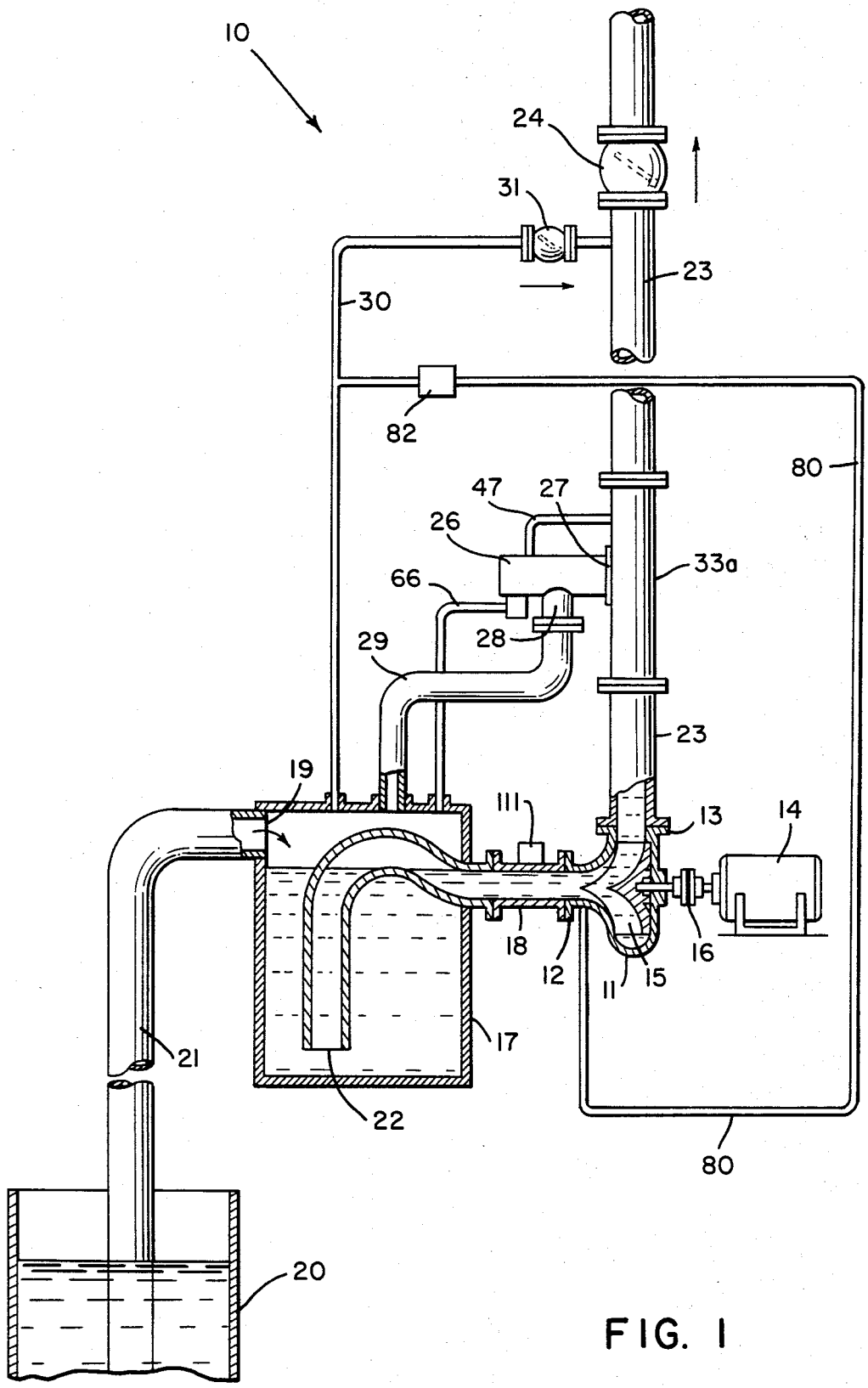
FIG. 1 is a side elevational view, partially in section, illustrating a self-priming system for liquid pumps and incorporating a priming valve in accordance with the present invention.

Referring now to the drawings, and particularly to FIG. 1 thereof, there is shown a fluid system 10 which includes a pump 11 having an inlet 12 and an outlet 13. Although the pump as shown is a single stage pump, a similar horizontally-arranged, multiple stage pump could be provided instead. Pump 11 is driven by an electric motor 14, which is connected to the pump impeller 15 by means of a suitable drive connection 16. A suction tank 17 is connected with pump inlet 12 through line 18. Suction tank 17 includes an opening 19 connected through a pipe 21 to storage tank 20. Inlet line 18 extends into suction tank 17 and terminates in an inlet opening 22. Suction tank 17 is maintained with sufficient liquid from storage tank 20 by virtue of the differential pressure across pipe 21 resulting when liquid is pumped from suction tank 17.

A discharge line 23 extends in a generally vertical direction from pump outlet 13 and includes a check valve 24 positioned downstream of pump 11 a sufficient distance to provide a column of liquid of predetermined volume. A priming valve 26 is connected to discharge line 23 at tee 33*a* and includes an inlet 27 and an outlet 28. A discharge conduit 29 extends from outlet 28 to suction tank 17 to permit priming fluid which passes through valve 26 to flow into suction tank 17 to allow pump 11 to prime itself again. The liquid between check valve 24 and priming valve 26 provides a column of liquid which is of sufficient quantity to permit priming of the pump.

An air relief conduit 30 extends from suction tank 17 to discharge line 23 immediately upstream of check valve 24 to permit air from suction tank 17 to replace the priming liquid. A relief conduit check valve 31 allows movement of air only toward discharge line 23 in order to prevent liquid from passing through conduit 30. When liquid in discharge conduit 23 is permitted by priming valve 26 to return to tank 17, air in tank 17 is displaced by the priming liquid and passes through relief conduit 30 and check valve 31 to replace the priming liquid in discharge conduit 23. The air cannot return to tank 17, because of check valve 31, and is therefore forced through check valve 24 upon resumption of liquid flow.

A vent line 80 extends from the eye of pump 11 to relief conduit 30 to vent air which enters the pump when suction is lost. A vent valve 82 is provided in vent line 80 to control the rate and direction of flow through the vent line, as will be hereinafter described.

Figure 2:
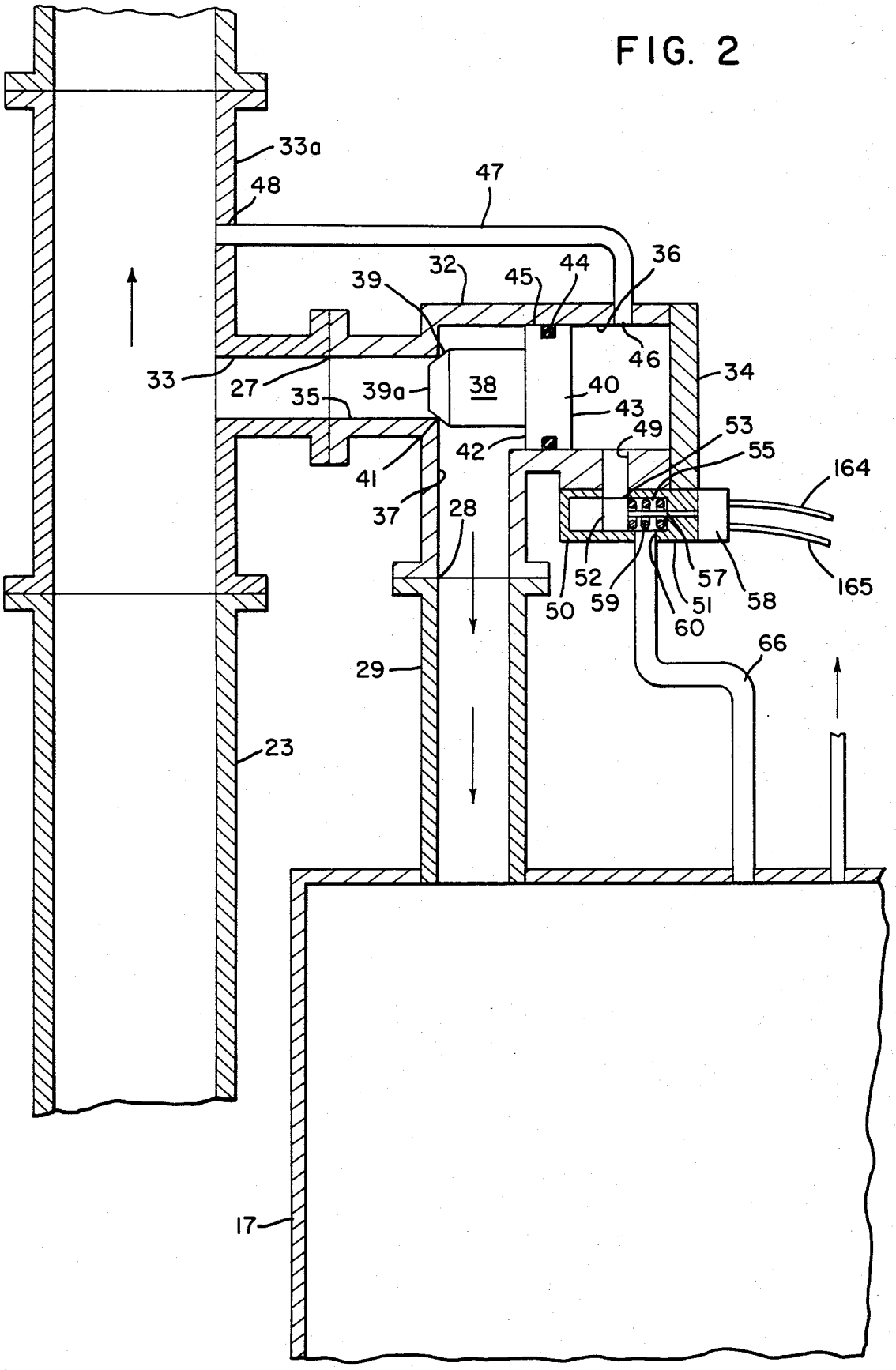
FIG. 2 is a fragmentary cross-sectional view showing one embodiment of a priming valve in accordance with the present invention.

Referring now to FIG. 2, priming valve 26 is in the form of a tee-shaped housing 32. Inlet 27 of priming valve 26 is bolted to a corresponding opening 33 in discharge line 23, and opening 33 can be provided in a tee section 33*a*. Housing 32 is closed at its opposite end by means of an end cap 34, and includes an inlet passageway 35 extending from inlet 27 to an inner chamber 36, which is of cylindrical form and of greater cross-sectional area than that of inlet passageway 35. An outlet passageway 37 interconnects outlet opening 28 and inner chamber 36 to permit communication between inlet 27 and suction tank 17 through valve discharge conduit 29.

Slidably carried within housing 32 is a valve member 38 which includes a valve face 39 positioned at one end thereof and a piston 40 positioned at the other end. Valve face 39*a* is adapted to selectively block and unblock inlet passageway 35 by seating on or moving from valve seat 41, respectively. Piston 40 has a cross-sectional area which is greater than the opening area of valve seat 41 and includes an inner face 42 and an outer face 43. An O-ring 44 is received in an annular recess in the outer periphery 45 of piston 40.

A first aperture 46 is provided in housing 32 adjacent end cap 34 to receive one end of a first conduit 47, the opposite end of which is positioned in an aperture 48 in discharge line 23. A second aperture 49 extends through housing 32 adjacent end cap 34 and communicates with a pilot valve 50.

Pilot valve 50 includes a housing 51 and a valve member 52. An inlet opening 53 communicates with an inner chamber 55. Inlet opening 53 of pilot valve 50 communicates with second aperture 49 in inner chamber 36 of priming valve 26. Inlet 53 is blocked or unblocked by valve member 52 to close and open the same, respectively. Valve member 52 includes a stem 57 connected to a solenoid 58 and is biased to the open position by means of a spring 59. An outlet 60 communicates with tank 17 by means of pilot valve conduit 66.

Figure 3:
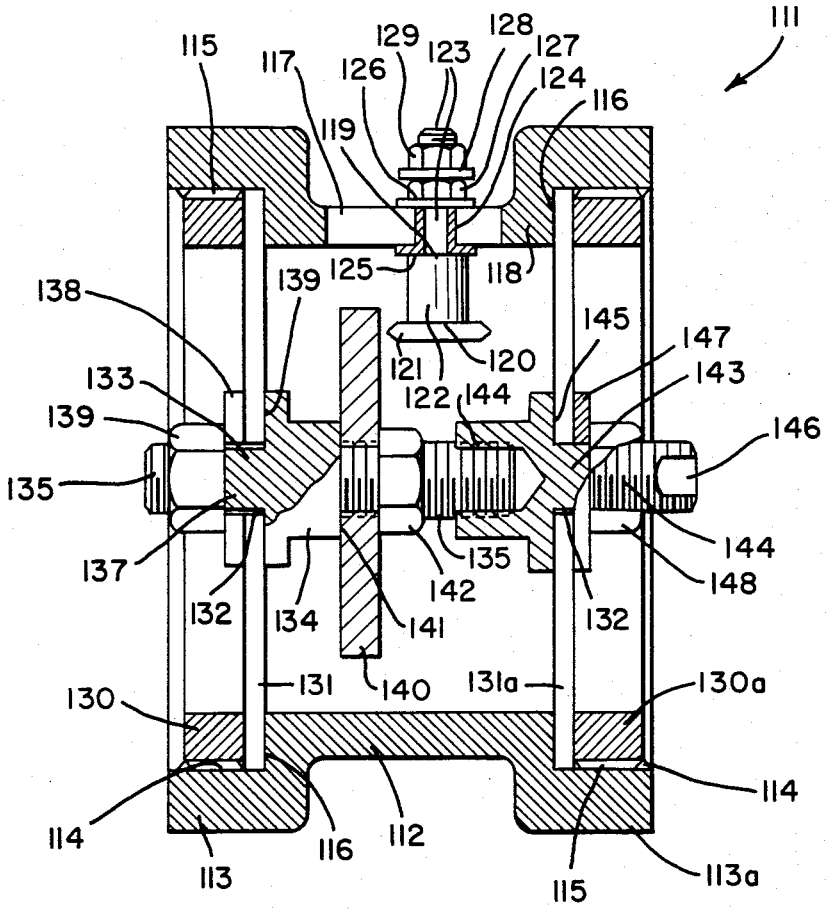
FIG. 3 is a cross-sectional view of one form of flow sensing device incorporating a double diaphragm element and shown in one position relative to a fluid conduit.

FIG. 3 shows a flow sensing unit 111 having a generally cylindrical body 112 with flanged ends 113 and 113*a*. Each flange has an interior recess 114, circumferentially, and carries female threads 115. The bottom of each recess terminates in an abutment 116. As shown in FIG. 3, the midportion of body 112, between the flanges 113 and 113*a*, has a longitudinal slot 117 in the upper section of the cylinder wall 118. A contact element 119, machined from electrically conductive material, has one end 120 contoured in a generally circular shape and is progressively reduced in diameter to form a contact point 121 and a body section 122 while the upper section terminates in a threaded end 123 which is of such a diameter as to permit it to slidably fit into slot 117, even when insulating collar 124 is inserted therebetween. Shoulder 125 on body 122 abuts against collar 124 to hold it in contact with the inside face of wall 118. A non-conducting washer 126 on the outside surface of the slotted wall insulates the metallic nut 127 engaging thread 123 to hold the contact element in fixed position. A washer 128 made from an electrically conductive material and having a conducting element affixed thereto is fitted over threaded end 123 and on top of nut 127, and is locked in position by a second nut 129.

Threaded rings 130 and 130*a* of proper diameter and depth are installed within the threaded recesses 114 in flanges 113 and 113*a* and confine diaphragm discs 131 and 131*a* at each of the flanged ends. The diaphragms 131 and 131*a* may be made of any suitable materials and each has an aperture 132 at its center. A stem 133, preferably of non-conductive material, having a large stepped hub 134 at its mid-section and a smaller diameter threaded portion 135 at each end, is positioned so that its leftward threaded end 137 fits through aperture 132 in left end diaphragm 131 and fixes it to a washer 138 on the left end side of stem 133 and shoulder 139 on hub 134. A nut 139 acts as a lock to ensure immobility. A metallic disc 140 defining another contact element is mounted on the right hand threaded end 135 of stem 133 and is positioned against shoulder 141 and held thereto by threaded nut 142. An extension 143, having an internal thread 144 at its left end which engages threaded portion 135 of stem 134, includes an externally threaded portion 144 which extends from a shoulder 145 and fits through aperture 132 in the center of diaphragm 131*a*. The outer end of externally threaded portion 144 has a wrench flat 146 so that it may be turned within the diaphragm to adjust the lateral spacing of the two diaphragms. Washer 147 and lock nut 148 hold the stem tightly against diaphragm 131*a*, thereby preventing any rotation.

Figure 4:
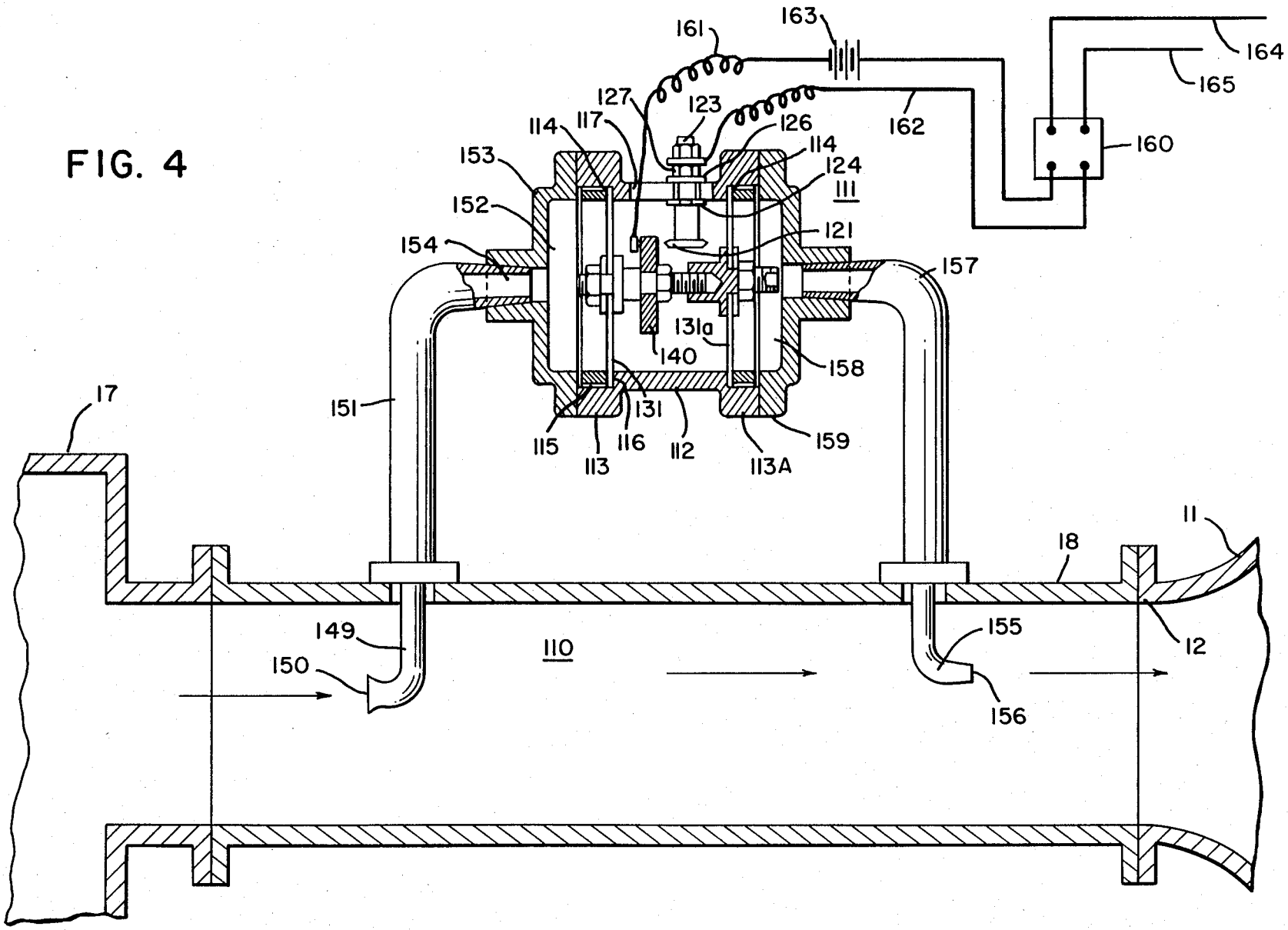
FIG. 4 shows the flow sensing device of FIG. 3 connected to a flow conduit.

FIG. 4 shows how sensing unit 111 may be installed. Inlet line 18 extends from suction tank 17 to inlet 12 of pump 11 (see FIG. 1) and includes a first tube 149 having a flared inlet 150 facing against the direction of flow. Conduit 151 connects first tube 149 with a chamber 152 formed between an end closure 153 and diaphragm 131 through opening 154 in the closure. End closure 153 can be attached to flange 113 in body 112 by bolts (not shown) or by any other convenient means. A second tube 155, positioned downstream of first tube 149, includes an inlet 156 facing in the direction of flow, and communicates with chamber 158 through conduit 157. Chamber 158 is between end closure 159 and diaphragm 131*a*.

In the operation of the system, when pump 11 draws liquid from suction tank 17 and pumps it into discharge line 23, the flow opens check valve 24. The static pressure head within discharge line 23 acts upon valve face 39*a* of priming valve 26 to urge valve member 38 away from valve seat 41 and also acts against outer face 43 of piston 40 through conduit 47. Because of the cross-sectional area difference, the force exerted on piston 40 exceeds the force exerted on valve face 39*a*, and inlet passageway 35 is closed. Valve member 52 is biased by spring 59 to open pilot valve inlet 53.

When flow exists within inlet line 18 the velocity energy is transmitted to flow sensor 111 as an increased pressure into the left end chamber 152 tending to force diaphragm 131 in a rightward direction. The pressure in the right hand chamber 158 is diminished by virtue of the fact that inlet 156 of downstream tube 155 faces in the same direction as that of the flow. Thus, the entire diaphragm assembly moves rightwardly as shown in FIG. 4. As the assembly moves rightwardly, the metallic disc 140 engages contact element 121 to act as a switch and provides a signal to solenoid 58 to maintain valve 50 closed.

If the pump exhausts the liquid in suction tank 17, check valve 24 closes to prevent reverse flow in discharge line 23. A no flow condition causes the contacts in flow sensor 111 to open, thereby opening the circuit to solenoid 58 and permitting spring 59 to move valve member 52 to provide an open path for liquid from pilot valve inlet 53 to conduit 66. The pressure within chamber 36 drops and permits valve member 38 to move away from valve seat 41 and thus return the liquid within discharge column 23 to suction tank 17 to reprime the pump. Control device 160, which can be, for example, an amplifier, a time delay, or the like, is connected to suitable conductors 161,162 extending from movable disc contact 140 and fixed contact 121, respectively. A power source, such as battery 163, or the like, can provide the power for operating control device 160. Conductors 164 and 165 extend from control device 160 to solenoid 58.

While particular elements of the present invention have been illustrated and described, it will be apparent to those skilled in the art that various changes and modifications can be made without departing from the spirit and scope of the invention, and it is intended to encompass within the appended claims all such changes and modifications which fall within the scope of the present invention.

What is claimed is:

1. In a self-priming pump system including a liquid pump, a suction tank in communication with the pump, a discharge line connected to the pump and including a check valve positioned downstream of the pump a distance sufficient to provide a column of priming liquid, and a priming valve having an inlet in communication with the discharge line and an outlet in communication with the suction tank and positioned between the pump outlet and the check valve, the priming valve responsive to liquid flow from the pump to automatically permit flow of the priming liquid from the discharge line to the suction tank when suction at the pump inlet is lost, the improvement comprising:

a. a piston housed within the priming valve and slidably positioned within a cylinder, one face of said piston directly exposed to the liquid in the discharge line at the discharge line static pressure, and the other face of said piston exposed to the liquid in the discharge line at the discharge line static pressure via the priming valve, the area of said one face of said piston being greater than the area of said other face to maintain the priming valve in a closed condition;

b. a conduit connecting the one face of said piston to the suction tank;

c. a pilot valve blocking said conduit; and d. flow sensing means to sense liquid flow through the pump and operatively connected with said pilot valve to cause it to open under a given flow condition to relieve the pressure on the one face of said piston to cause the priming valve to open responsive to the given flow condition.

2. The self-priming pump system of claim 1 wherein said flow sensing means comprises:

(a) a housing having an internal cavity;

(b) a flexible diaphragm positioned within said cavity to define a sensing chamber therewithin;

(c) means to interconnect said sensing chamber with a fluid conduit;

(d) first contact means movable with said diaphragm;

(e) second contact means carried by said housing;

(f) said first contact means and said second contact means defining a switch means responsive to movement of said diaphragm.

3. The self-priming pump system of claim 2 including a control circuit having a source of power, an electrically operated controlled element, and switch means, whereby actuation of said controlled element is governed by said switch means in response to flow through said pump.

4. The self-priming pump system of claim 2 wherein said first contact means and said second contact means are spaced from each other and the spacing therebetween is adjustable.

5. The self-priming pump system of claim 2 wherein said interconnection means include means to sense fluid pressure within said conduit.

6. The self-priming pump system of claim 2 wherein said interconnection means includes means to sense total pressure within said conduit.

7. The self-priming pump system of claim 6 wherein said sensing means includes a first pilot tube positioned to face upstream relative to liquid flow.

8. The self-priming pump system of claim 2 wherein a pair of spaced flexible diaphragms are provided to define two spaced pressure sensing cavities.

9. The self-priming pump system of claim 8 wherein said spaced diaphragms are interconnected.

10. The self-priming pump system of claim 9 wherein said first contact means is common to both said diaphragms.

11. The self-priming pump system of claim 10 wherein said switch means is intermediate said spaced diaphragms.

* * * * *